United States Patent [19]

Simonsen

[11] 4,224,487

[45] Sep. 23, 1980

[54] FAST ACTING EXPLOSIVE CIRCUIT INTERRUPTER

[76] Inventor: Bent P. Simonsen, 27 Starfish Ct., Newport Beach, Calif. 92663

[21] Appl. No.: 880,700

[22] Filed: Feb. 23, 1978

[51] Int. Cl.[2] ..... H01H 39/00

[52] U.S. Cl. ..... 200/61.08

[58] Field of Search ..... 200/61.08, 151, 306; 60/632, 635, 636, 637, 638; 89/1 B; 102/201, 203, 262

[56] References Cited

U.S. PATENT DOCUMENTS

| | | | |
|---|---|---|---|
| 2,477,837 | 8/1949 | Strom | 200/151 X |
| 3,003,045 | 10/1961 | Tichenor | 200/61.08 |
| 3,277,255 | 10/1966 | Mattsson et al. | 200/61.08 |
| 3,793,501 | 2/1974 | Stonestrom | 200/61.08 |
| 3,873,786 | 3/1975 | Lagofun | 200/61.08 |
| 3,932,717 | 1/1976 | Dike et al. | 200/61.08 |
| 3,953,690 | 4/1976 | Korr et al. | 200/61.08 |

*Primary Examiner*—James R. Scott
*Attorney, Agent, or Firm*—Michael H. Laird

[57] ABSTRACT

A high speed, high impedance explosive circuit interrupter is disclosed which attenuates the magnitude and duration of fault currents accompanying circuit faults in electrical circuits protected by conventional circuit isolation apparatus. By so doing, the disclosed elements improve the operating speed and effectiveness of the breaking system and the protection of fault sensitive equipment.

6 Claims, 4 Drawing Figures

△ — UNINTERRUPTABLE POWER SUPPLY

□ — INTERRUPTER

Ⓘ — POWER DIRECTION DETECTOR

Ⓘⓘ — CURRENT MAGTITUDE DETECTOR

FAST ACTING EXPLOSIVE CIRCUIT INTERRUPTER

BACKGROUND OF THE INVENTION

A variety of mechanical and electrical circuit breaking systems are known to the art. Many, if not all of these, are effective in most applications, i.e., low voltage and current or circuit equipment which is relatively insensitive to electrical power disturbances. However, many systems, particularly high speed computers, are not so tolerant to circuit disruption or voltage transients and require high speed isolation of circuit faults. A number of these systems involve high voltages and/or currents, e.g., power loads on the order of 25 kw and higher.

Most electrical breakers are relatively effective at low load. However, in higher load applications these electrical breakers become very critical elements and must be sized for higher power levels at considerable expense. Most mechanical breaking systems are obviously inapposite in such applications, due to the time required for their operation and their consequent inability to rapidly isolate faults.

Numerous explosive devices are also known. These often have the advantage the they are faster operating than strictly mechanical apparatus and are much less expensive than are purely electrical breakers in high load applications. Devices illustrative of this type are described in U.S. Pat. Nos. 3,110,855, Chumakov, and 2,892,062, Bruckner et al, incorporated herein be reference. These publications also elaborate, to some extent, on the nature of problems involved in certain circuit isolating devices..

Those devices, and other apparatus of similar design, also suffer from several disadvantages. Notable of these is their failure to withstand the magnitude and duration of induced breaking voltage. While the reasons for these deficiencies are not known with certainty, the deficiencies of prior art explosive breakers under high loading may be due to their inability to rapidly quench the spark or ionization between severed electrode parts.

It is therefore one object of this invention to provide an improved circuit breaking apparatus and method. Another object is the provision of an apparatus for rapidly breaking high load circuits and isolating faulty elements while withstanding the magnitude and duration of induced breaking voltage. Yet another objective is the provision of an explosive breaker which takes the most advantage of the speed and low energy signal demands of explosive breakers while overcoming the inherent deficiencies of prior art systems of that type.

Therefore, in accordance with one embodiment there is provided a high speed, high impedance explosive circuit interrupter capable of operating on low energy signals, at high speed while minimizing system exposure to the circuit faults and fault current magnitude and duration.

This apparatus is best considered by reference to the drawings of which:

Figure 1:
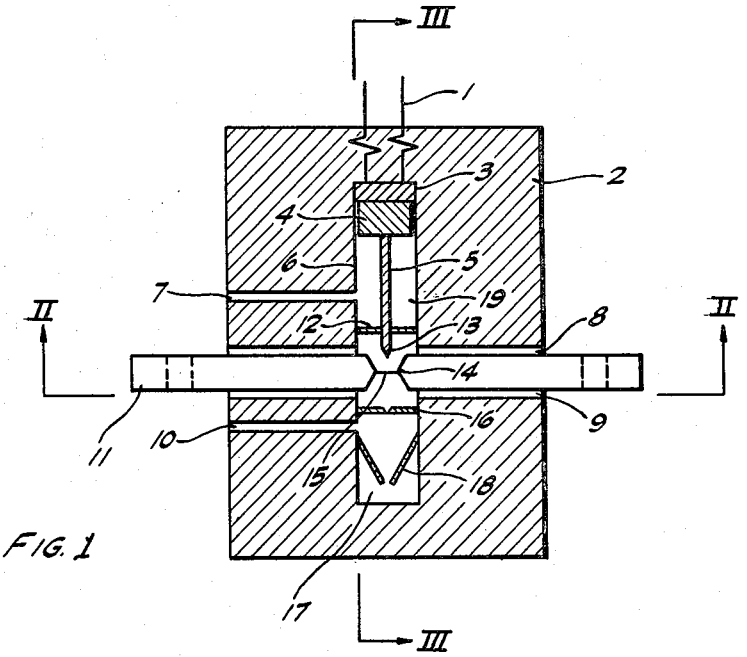
FIG. 1 is a side sectional view of one contemplated interrupter illustrating several concepts of the invention.
Figure 3:
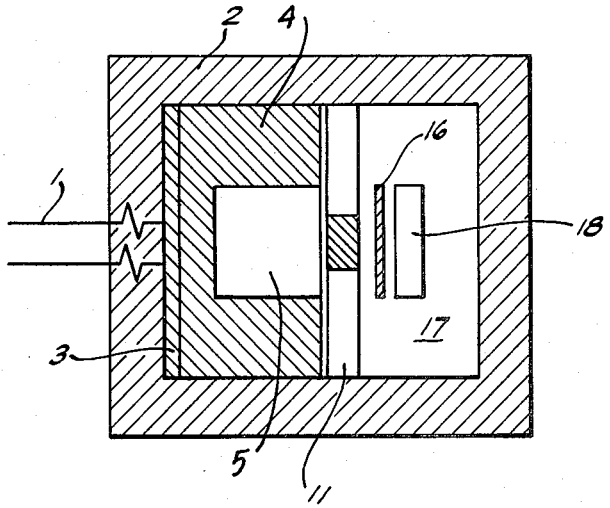
Figure 4:
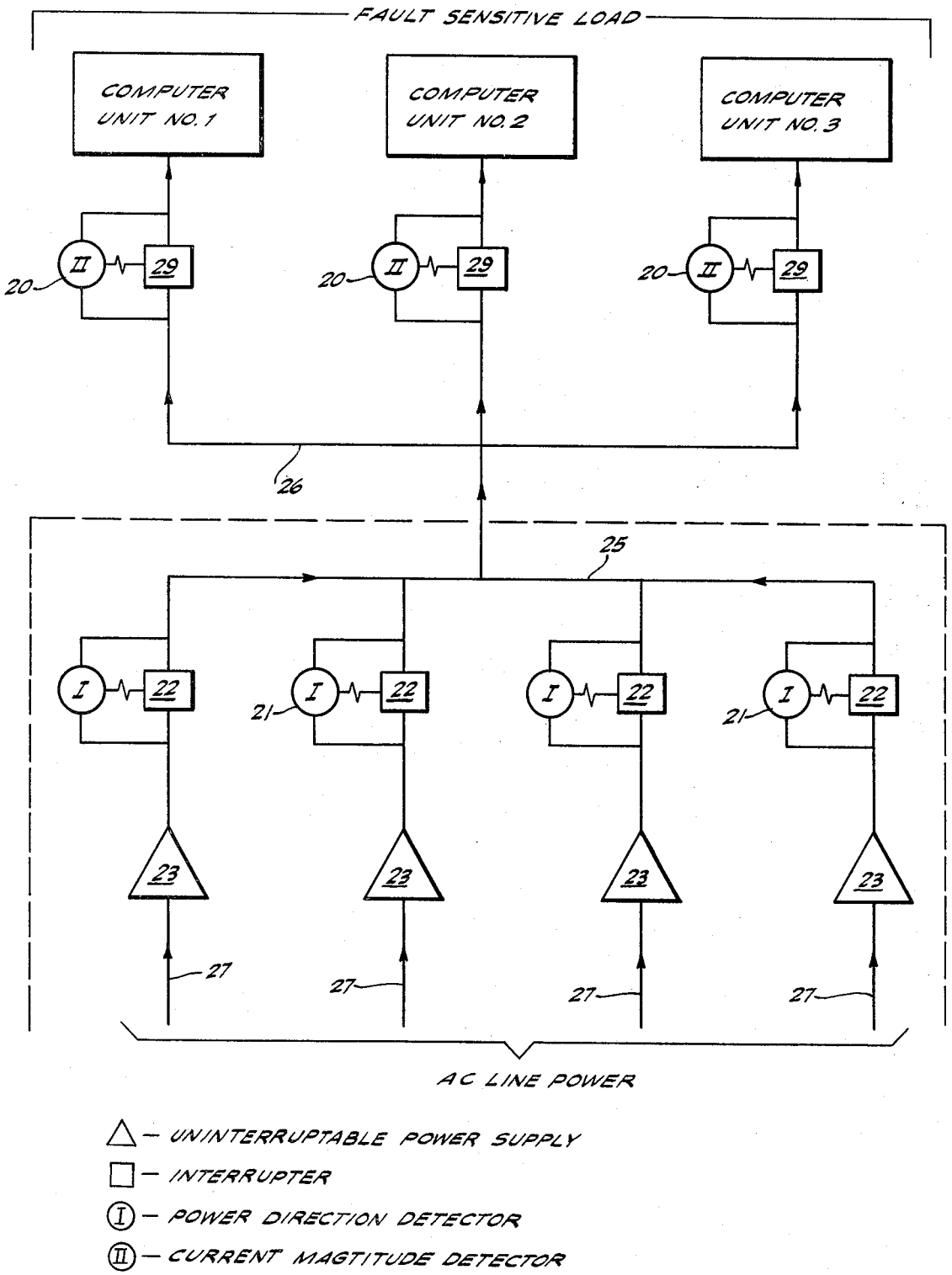

FIG. 3 is a bottom sectional view of the apparatus illustrated in FIG. 1 taken along section II—II; and FIG. 4 is a schematic circuit diagram illustrating one of the numerous potential applications of the interrupters of this invention, in particular, in combination with a plurality of parallel uninterruptable power supplies typically used to isolate computer installations from supply current and voltage variations.

The circuit interrupter illustrated in FIG. 1 comprises housing 2 having an internal cavity separated into longitudinally displaced upper and lower portions 19 and 17. Electrical terminals 11 enter the cavity from either side at a point intermediate each end of the cavity, preferably at an angle substantially perpendicular to the longitudinal axis of the cavity and to the travel of cutting element 5.

Cutting element or blade 5 is slidably mounted within upper cavity 19 and is attached to plunger 4 which separates the cutting element from explosive charge 3. Signal transmission lines 1 enter the cavity into electrical communication with a detonater in the explosive charge from the top of the apparatus.

The combination of the plunger-like driving means 4 and cutting element 5 is such that during their travel along the longitudinal axis of cavities 19 and 17, the guiding surfaces of piston 4 remain in close proximity of walls 6 of upper cavity portion 19 thereby isolating that part of the cavity below the plunger from the gasses emitted by the explosion of charge 3. Upper cavity 19 is provided with venting means 7 for communicating gasses compressed below piston 4 and combustion products of charge 3 from the cavity to the apparatus exterior to avoid pressure build up. This arrangement has the further advantage of isolating conductive element 15 and bus bars or other electrical conductors 11 from the high pressure explosion products of the explosive charge.

Also illustrated in upper cavity 19 are insulating and sealing means 12 which are preferably fixed to the interior cavity walls and make contact with the surfaces of cutting element 5. This arrangement further isolates the circuit breaking zone, i.e., the environment of conductive element 15, from explosion products and high pressures. The apparatus is further provided with vents 8 and 9 running laterally along the surfaces of conductors 11 for rapidly equalizing pressure within the breaking zone with external pressure.

Lower cavity portion 17, in this embodiment, comprises lower insulating means 16 which can be designed in substantially the same manner as insulating means 12. However, insulating means 16 is here illustrated as being connected at its center and cut substantially through prior to operation to facilitate passage of blade 5. Both insulating means 12 and 16 are preferably constructed of high impedance flexible materials which will allow the passage of cutting element 5 while maintaining contact with its outer surfaces.

Lower cavity 17 also contains vent means 10 for rapidly equalizing pressure between that zone and the external pressure and allowing the escape of any gasses compressed in that zone.

Means for capturing and preventing recoil of cutting blade 5 are illustrated schematically at 18. The function of this element is to assure that, once having passed through retaining means 18 and to its point of furthest travel along the cavity axis, cutter 5 will not recoil toward the upper end of the device.

Figure 2:
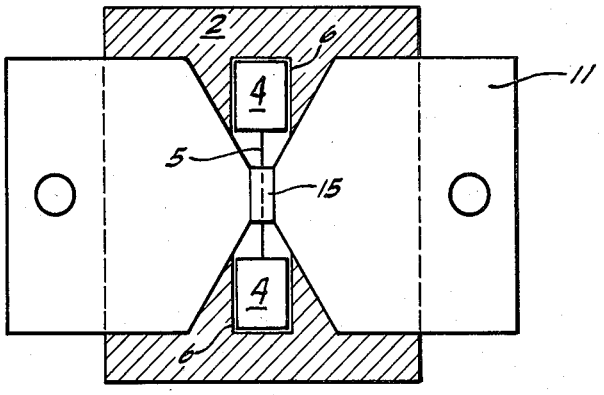
FIG. 2 is a side sectional view of the apparatus illustrated in FIG. 1 taken along the section III—III.

FIG. 2, which illustrates the apparatus of FIG. 1 along section III—III, shows that the cutting element 5 need not extend across the full width of the upper or lower cavities, but can be reduced in width to an extent sufficient to completely overlap the width of conductive element 15.

Conductor 11 is reduced in width at the point at which it joins breakable conductive element 15 to occupy only a minor portion of the cavity. This combination assures that blade 5 will completely sever and isolate both sides of conductor 11 in its passage downwardly through filament 15. While preferable, this arrangement is not essential to all aspects of this invention; numerous other arrangements can be envisioned. For instance, the lateral dimension of bus bars 11 could be the same up to the point of their contact with filament 15 in which case the filament could extend across the full lateral extent of the cavity. While that arrangement would allow for higher current passage through the device, it is often not essential and, when it is not required, the arrangement illustrated in FIG. 2 is preferable since it provides for overlap of cutting element 5 to either side of filament 15 while at the same time strengthening element 5 in both longitudinal and lateral dimensions by piston structure 4. This arrangement, in turn, affords the flexibility of forming cutting element 5 of a very thin piece of insulating material and positioning conductors 11 more closely to each other at their point of juncture with the filament.

FIG. 3 further illustrates the manner in which conductors 11 taper as they approach the juncture with the filament. This bottom view taken along section II—II of the apparatus illustrated in FIG. 1 also illustrates schematically the manner in which driving means 4 can be constructed to surround cutting element 5 on three sides and substantially accomodate the interior surfaces of the cavity walls 6 along the complete longitudinal travel of the cutting element.

Housing 2, piston 4 and cutting element 5 are preferably constructed of highly insulating materials of which a wide variety are known. Illustrative are numerous synthetic resins such as the polyolefinhomo- and copolymers, phenolic resins and the like. The design of this apparatus can obviously be varied in numerous respects without departing from the scope of this invention. For example, housing 2 can be surrounded by steel reinforcing element while cutting means 5 can extended across the full width of cavities 17 and 19 in which case plunger driving means 4 would contact and be affixed to cutting element 5 only at the top. The cavity could also be cylindrical or elliptical to accommodate plungers and cutting elements of different design.

It is also possible to eliminate one or more of venting means 7, 8, 9 or 10 while maintaining many of the advantages of this apparatus. However, venting means 7 which release explosion products from the cavity interior are particularly preferred due to the added ability this system provides for isolating filament 15 from the conductive compressed combustion products.

Seals 12 and 16 can obviously be designed in a variety of ways, their primary objective being to prevent ionization of gas or compressed combustion products below seal 16 after passage of the blade therethrough, and to isolate filament 15 from explosion products passing piston 4 or gas compressed beneath plunger 4 in the early stages of its travel. In fact, the need for seal 12 can be reduced by adequate design of plunger 4 so that its walls substantially accommodate and touch the interior surfaces of upper cavity 19 along the full travel of the piston and cutting element. While not essential to all aspects of this invention, seal 16 is preferred since, it serves to prevent ionization and sparking below the seal level. Thus, once having passed through seal 16, the blade effectively isolates both parts of conductors 11.

While seals 12 and 16 and blade 5 can be constructed of any insulating material of suitable physical properties, certain materials are preferred and facilitate rapid fault current isolation and minimize its magnitude and duration. These materials are fluoride containing substances that may release fluorine when exposed to the high temperatures existing in electrical arcs. Illustrative of these are the hydrocarbon polymers having fluorine to carbon molar ratios of at least about 0.1, preferably at least about 0.2. While the seals and cutting element can be constructed completely of such fluoride containing materials, it is essential only that the outer surfaces of these elements exposed to the spark of broken filament 15 be coated therewith. However, to assure the structural stability to these elements when composed completely of such polymers, the polymers should have melting points of at least about 150° and preferably at least about 250° F. Illustrative materials of this type are polytetrafluoroethylene, fluorinated polypropylene, polyethylene, ethylenepropylene copolymers and homo- and copolymers of ethylene, propylene, butene-1, and higher olefins with one or more dissimilar olefin monomers.

A variety of suitable explosive devices are known. These should react promptly to electrical signals communicated by signal leads 1 and propel plunger 4 and blade 5 through breakable filament 15. Some of these are discussed in the U.S. patents referred to above and elsewhere in literature. A variety of suitable explosive compositions and detonating devices are commerically available from suppliers such as Holex Incorporated of Hollister, Calif. Such electro-explosive devices should constitute a charge sufficient to move blade 5 completely through element 15 in a matter of five, preferably two milliseconds or less and to react promptly to the signal current. For this reason the composition of charge 3 and the magnitude of signal 1 should be correlated such that the detonating signal always exceeds the recommended firing current for the charge detonator.

These devices are suitable for any application requiring circuit interruption and rapid component isolation. They are particularly sueful for isolating faulty elements from critical electrical circuits. They can be made responsive to essentially any one or a combination of system parameters such as upstream or downstream voltage or current, frequency variation, or some ancillary variable such as a process temperature, flow rate or the like. In direct voltage systems they, of course, can be made responsive to upstream or downstream current direction. One such application is illustrated in FIG 4. It is essential only that a suitable detector be employed at the desired location to detect an unacceptable variation of these or other parameters.

FIG. 4 illustrates only two of the numerous potential applications of these high speed interrupters. This Figure illustrates, in schematic form, a portion of an integral uninterruptable power supply (UPS) and computer installation involving control and conversion of potentially defective AC line power to stabilized current, i.e., current of stabile voltage and magnitude free of line variations.

Alternating line power is supplied to four UPS systems 23, that supply constant power to bus 25 and 26. The controlled alternating current supplies computer units 1, 2 and 3. A variety of so-called uninterruptable power supplies are commerically available. Illustrative is the system described in "Specifying Power Line Buffer Equipment for Computer Systems," John E. McGregor, *Computer Design,* November, 1973. Similar equipment is available from Emerson Electric Co., Industrial Controls Division, Santa Ana, Calif. Similarly, a variety of suitable rectifiers are well known to the art. Specific elements do not constitute essential aspects of this invention. They are referred to only for purposes of illustrating the manner in which my high speed interrupters can be employed.

Interrupters 22 are positioned downstream of UPS systems 23 and are controlled, in this instance, by their respective electrical power direction detectors 21 having leads spanning each respective interrupter. While a power direction fault might occur in one of several ways, the most likely possibility involves failure of one of the UPS units. In that instance, power would then flow from the remaining systems through bus 25 to the faulty UPS system. Power direction detector 21 on that line would detect the change in power direction and pass a detonating signal to the corresponding interrupter which would then isolate the remaining UPS systems and the critical computer load from the fault.

In this embodiment further protection is provided by current magnitude detectors 20 which control the three circuit interrupters positioned on the respective leads from bus bar 26, and which, when required, isolate bus bar 26 and the power supply circuit from overload faults downstream in one of the computer units. These current magnitude detectors will, depending upon their sensitivity, recognize any increase or decrease in current demand in the computer units and, in so doing, will pass a detonating signal to the corresponding interrupter 29 thereby isolating that part of the load from the remaining load and power supply.

The operation of each circuit interrupter is as described with respect to FIGS. 1—3 above. A variety of circuit monitors capable of detecting circuit aberations and developing detonating signals are known to the art. These components do not constitute an essential aspect of this invention. They are referred to herein only in way of illustration. Suitable power direction detectors (reverse power relays) and current magnitude detectors (current sensitive relays) are available from Widmar Electronics, Inc., Torrance, Calif.

The aforegoing disclosures and specific embodiments illustrate several aspects of this invention. However, they are intended only for that purpose and should not be construed as limiting the scope of applications of those concepts. Numerous other variations and modifications of these concepts will be apparent to one skilled in the art and are contemplated within the scope of this invention.

What is claimed is:

1. A high speed, high impedance, explosive circuit interrupter comprising a housing defining an internal cavity having side walls substantially parallel to the longitudinal axis of said cavity, at least two load-carrying conductors entering said cavity laterally from opposing sides and at opposing points therein spaced from either end of said cavity, said conductors being electrically conductively connected with each other within said cavity by a breakable high conductance filament, plunger-driven non-conductive cutting means slidably mounted along said longitudinal axis within said cavity and spaced from said filament toward a first end of said cavity for breaking said filament in traveling longitudinally from said first end of said cavity toward the other end thereof and for insulating said conductors from each other, said plunger having a lateral cross section conforming substantially to the lateral cross section of said cavity throughout the range of longitudinal travel thereof, for driving said cutting means through said filament upon detonation of the explosive element hereinafter defined and for isolating said filament from the gaseous products of explosion of said explosive element, an explodable element positioned within said cavity and between said plunger-driven cutting means and said first end of said cavity for forcing said cutting means along said longitudinal axis and through said filament upon detonation of said explosive element, said element having electrical terminals in electrical communication therewith for conducting a detonating signal from a signal generator to said explosive element, at least one venting means between said filament and said first end of said cavity for venting from said cavity gas compressed by either detonation of said explosive element or longitudinal travel of said cutting means upon detonation of said element and for attenuating the pressure increase around said filament during and after said detonation, and at least one venting means communicating between said cavity at a point therein spaced from said filament toward the other end of said cavity and the exterior of said cavity for venting from said cavity gas compressed within the portion of said cavity spaced from said filament toward the other end of said cavity.

2. The apparatus of claim 1 further comprising upper electrically insulating gas sealing means positioned within said cavity around said cutting means and between said filament and said venting means for excluding gas resulting from said detonation of said explosive element or gas compressed by such detonation or by longitudinal travel of said cutting means, from the vicinity of said filament.

3. The apparatus of claim 1 further comprising lower electrically insulating means positioned within said cavity and longitudinally axially spaced toward the other end of said cavity from said filament and being penetrable by said cutting means upon detonation of said explosive element and longitudinal travel of said cutting means, for preventing sparking between said conductors upon cutting of said filament by said cutting means after said cutting means has penetrated said lower insulating means.

4. The apparatus of claim 3 wherein said surface of said lower electrically insulating means is composed of a fluorine containing hydrocarbon polymer having a fluorine to carbon molar ratio of at least about 0.1.

5. The apparatus of claim 1 wherein, the surface of said cutting means is composed of a fluorine containing hydrocarbon polymer having a flourine to carbon molar ratio of at least about 0.1.

6. The apparatus of claim 1 further comprising cutting element retaining means for preventing the recoil of said cutting means from its point of maximum longitudinal travel from said first end of said cavity after said cutting means has passed through and severed said conductive filament.

* * * * *